US006735991B2

(12) United States Patent
Lurie et al.

(10) Patent No.: US 6,735,991 B2
(45) Date of Patent: May 18, 2004

(54) TAMPER RESISTANT LOCK ASSEMBLY

(76) Inventors: Alan E. Lurie, 52 Briarwood Dr., Huntington, NY (US) 11743; Joseph Thomas, 1873 Stewart Ave., New Hyde Park, NY (US) 11040

( * ) Notice: Subject to any disclaimer, the term of this patent is extended or adjusted under 35 U.S.C. 154(b) by 0 days.

(21) Appl. No.: 10/194,045

(22) Filed: Jul. 10, 2002

(65) Prior Publication Data

US 2003/0010072 A1 Jan. 16, 2003

Related U.S. Application Data

(60) Provisional application No. 60/304,277, filed on Jul. 10, 2001.

(51) Int. Cl.[7] ..... E05B 65/44; E05B 65/28
(52) U.S. Cl. ..... 70/78; 70/79; 70/131
(58) Field of Search ..... 70/78, 79, 80, 70/81, 84, 131, 132, 137

(56) References Cited

U.S. PATENT DOCUMENTS 1,530,655 A * 3/1925 Dowling ..... 70/116
2,573,450 A * 10/1951 Kallas et al. ..... 292/109
4,813,250 A * 3/1989 Yeh ..... 70/104
5,044,181 A * 9/1991 Roop et al. ..... 70/131
6,374,650 B1 * 4/2002 Newman ..... 70/131

* cited by examiner

*Primary Examiner*—Lloyd A. Gall
*Assistant Examiner*—Michael J. Kyle
(74) *Attorney, Agent, or Firm*—Carter, DeLuca, Farrell & Schmidt, LLP

(57) ABSTRACT

A tamper resistant lock assembly is disclosed which is configured to prevent keyless operation of the lock assembly. The tamper resistant lock assembly includes a lock housing having a bolt slidably supported therein and a strike. The lock housing is secured to a mounting plate which is adapted to be fastened to a movable member such as a door. The strike is adapted to be fastened to a support member such as a door jam at a position to facilitate engagement between the bolt and the strike when the movable member is in a closed position. The strike includes a C-shaped catch member defining a recess having an opening which is configured to receive an engagement portion of the strike when the movable member is in the closed position. The engagement portion of the strike is also C-shaped and defines a recess. When the engagement portion of the presently disclosed strike is engaged by the catch member of the presently disclosed bolt, a lip portion of the bolt is positioned within the recess of the engagement portion of the strike and a lip portion of the strike is positioned within the recess of the catch member of the strike to provide an interlocking engagement which resists tampering.

19 Claims, 4 Drawing Sheets

TAMPER RESISTANT LOCK ASSEMBLY

This application claims priority from U.S. Provisional application Serial No. 60/304,277 filed Jul. 10, 2001, the contents of which are incorporated herein by reference.

BACKGROUND

1. Technical Field

The present disclosure relates generally to a tamper resistant lock and, more particularly, to a tamper resistant lock having a novel strike and bolt design to prevent keyless operation of the lock.

2. Background to Related Art

Locks for retaining doors, drawers or other movable members in a closed position are well known. Such locks are commonly used on doors to homes, merchandise cabinets, desk drawers, etc. to protect the internal contents of a structure. These locks may include a key operated bolt which is mounted on a movable member, e.g., a door, and a strike which is mounted to a stationary member, e.g., a door jam. The strike includes a recess for receiving the bolt. The bolt is movable between a first extended locking position to a second retracted release position. Typically, the bolt is spring biased to the locking position and is movable to the release position by inserting a key into the lock and turning the key.

Generally, the bolt of a lock assembly includes an angled face and a rear retaining wall. The angled face is positioned to engage the strike when closing the movable member such that engagement between the angled face of the bolt and the strike urges or cams the bolt to the release position. In the release position, the bolt is able to pass over the strike to permit the movable member to close. When the rear retaining wall of the bolt passes over the edge of the strike defining the recess, the bolt is biased by the spring into the recess to lock the movable member in the closed position.

Typically, a clearance exists between the movable member and the stationary member which provides access to the bolt. One problem associated with the locks described above is that a flat tool, e.g., a credit card, can be inserted into the clearance into engagement with the angled face of the bolt. If a sufficient force is applied by the flat tool against the angled face of the bolt, the bolt can be moved from the extended position to the release position to facilitate opening of movable member without the use of a key.

Accordingly, a need exists for an improved lock assembly which cannot be released without the key associated with the lock assembly.

SUMMARY

In accordance with the present disclosure, a tamper resistant lock assembly is disclosed which is configured to prevent keyless operation of the lock. The tamper resistant lock assembly includes a lock housing having a bolt slidably supported therein and a strike. The lock housing is secured to a mounting plate which adapted to be fastened to a movable member such as a door. The strike is adapted to be fastened to a support member such as a door jam at a position to facilitate engagement between the bolt and the strike when the movable member is in a closed position. The strike includes a C-shaped catch member having a base portion, a sidewall portion, a transverse extension and a lip portion. The lip portion extends along an axis which is, preferably, substantially parallel to the sidewall of the catch member such that the lip portion, transverse extension and sidewall of the catch member define a recess having an opening which is configured to receive an engagement portion of the strike when the movable member is in the closed position.

The engagement portion of the strike also includes a sidewall portion, a transverse extension and a lip portion. The lip portion of the engagement portion is, preferably, substantially parallel to the sidewall portion of the engagement portion such that the lip portion, sidewall and transverse extension of the engagement portion also define a recess having an opening.

When the engagement portion of the presently disclosed strike is engaged by the catch member of the presently disclosed bolt, the lip portion of the bolt will position itself within the recess of the engagement portion of the strike and the lip portion of the strike will position itself within the recess of the catch member of the strike to provide interlocking engagement which resists tampering.

BRIEF DESCRIPTION OF THE DRAWINGS

Various preferred embodiments of the presently disclosed tamper resistant lock assembly are disclosed herein with reference to the drawings, wherein.

DETAILED DESCRIPTION OF THE PREFERRED EMBODIMENTS

Figure 1:
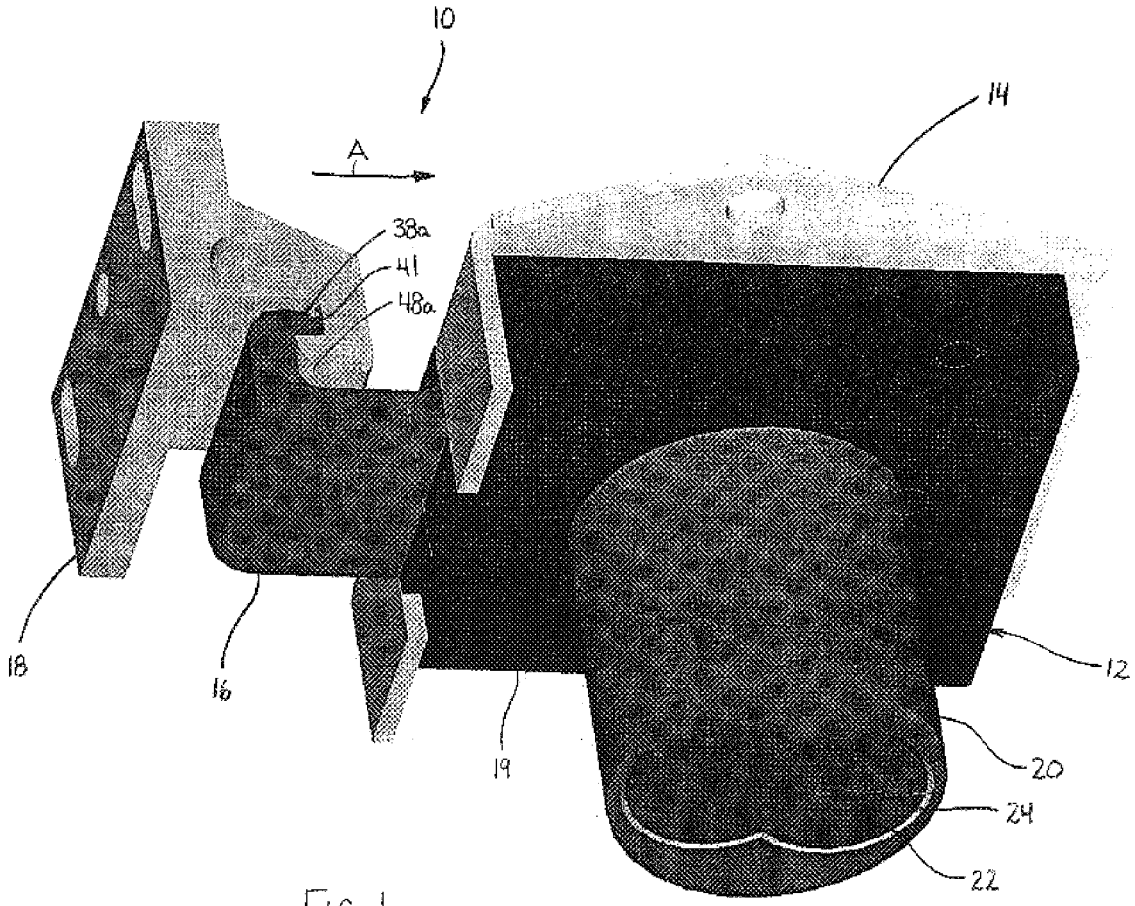
FIG. 1 is a top perspective view of one preferred embodiment of the presently disclosed tamper resistant lock assembly.

Preferred embodiments of the presently disclosed tamper resistant lock assembly will now be described in detail with reference to the drawings, in which like reference numerals designate identical or corresponding elements in each of the several views.

Referring to FIG. 1, the presently disclosed tamper resistant lock assembly, shown generally as 10, includes a lock housing 12, a mounting plate 14, a bolt 16 and a strike 18. Lock housing 12 includes a base portion 19, a core housing 20 and a core 22. Core 22 has a key slot 24 formed therein.

Figure 2:
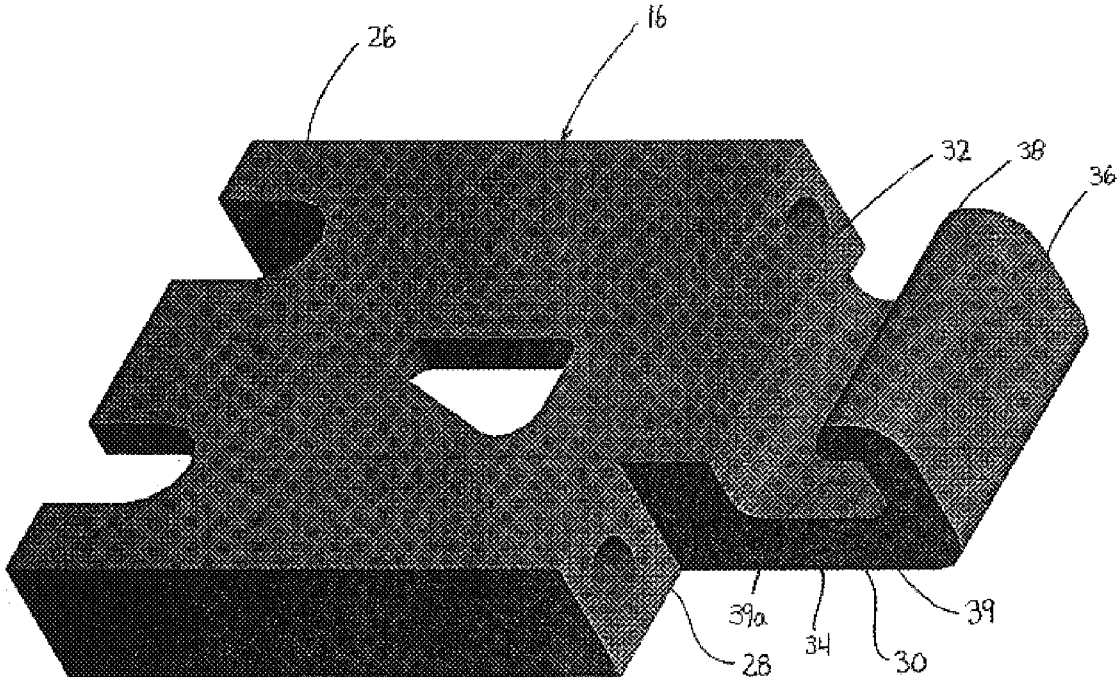
FIG. 2 is a perspective view of the bolt of the tamper resistant lock assembly shown in FIG. 1.

Referring also to FIG. 2, bolt 16 includes a proximal end 26 which is slidably positioned within base portion 19 of lock housing 12 and a distal end 28 having a substantially C-shaped catch member 30. Catch member 30 includes a base portion 32, a longitudinally extending sidewall portion 34, a transverse extension 36 and a lip portion 38. Preferably, transverse extension 36 is substantially perpendicular to sidewall portion 34 and lip portion 38 is substantially perpendicular to transverse extension 36 such that sidewall portion 34, transverse extension 36 and lip portion 38 define a recess 39. Alternately, these angles may be varied so long as the overall object of the assembly is achieved. Lip portion 38, transverse extension 36 and base portion 32 define a recess 39 defining an opening 39*a* for receiving an engagement portion of the strike which will be described in detail hereinbelow.

Figure 3:
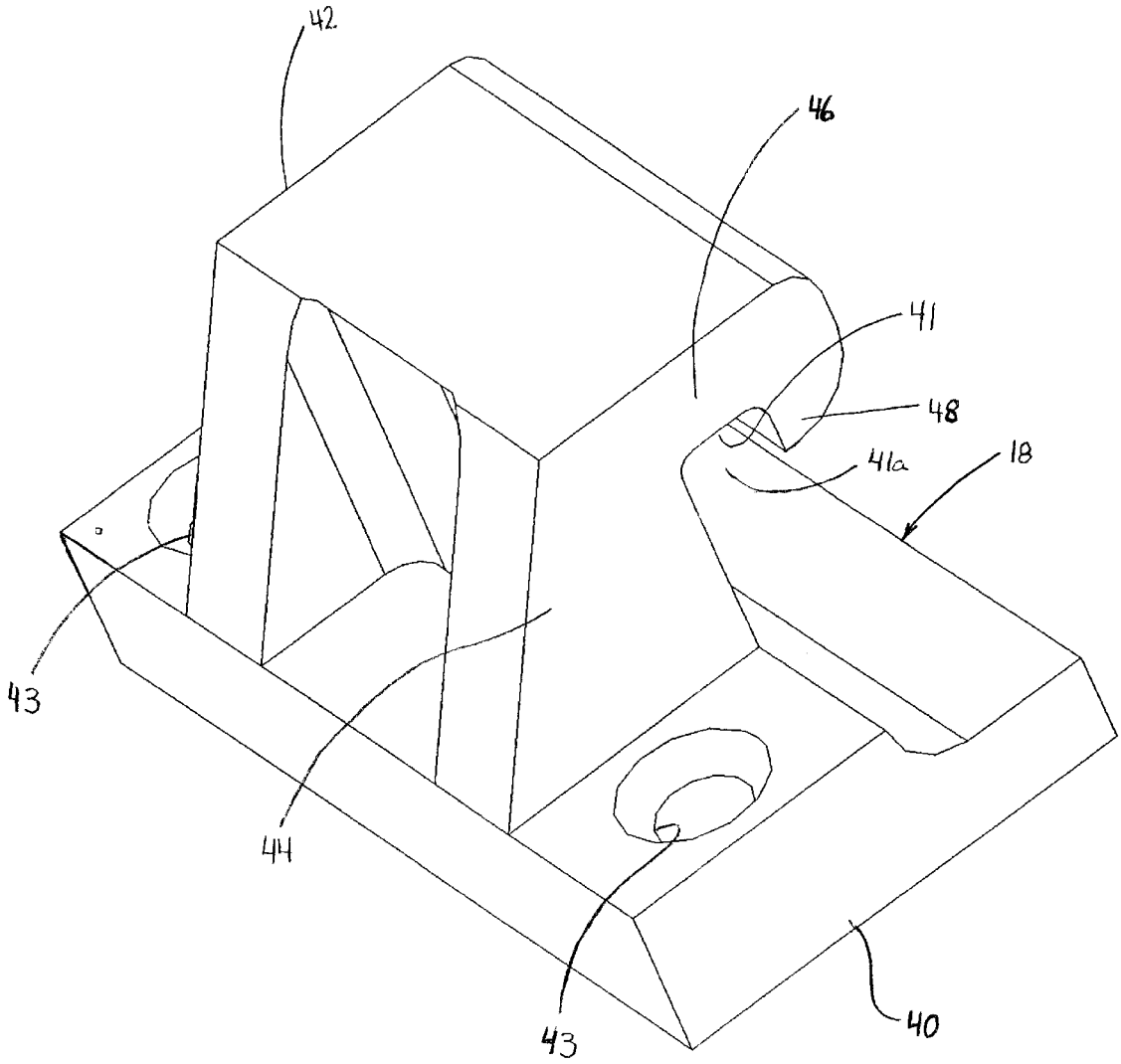
FIG. 3 is a perspective view of the strike of the tamper resistant lock assembly shown in FIG. 1.

Referring to FIGS. 1 and 3, strike 18 includes a base portion 40 and an engagement portion 42. Base portion 40 includes a plurality of throughbores 43 which are dimensioned to receive screws for securing strike 18 to a support member (not shown) such as a door jam. Alternately, other known fastening structure may be provided to facilitate attachment of strike 18 to a support member. Engagement portion 42 of strike 18 has a configuration similar to that of bolt 16 and includes a longitudinally extending sidewall portion 44, a transverse extension 46, and a lip portion 48. Lip portion 48, transverse extension 46, and base portion 40 define a recess 41 including an opening 41*a* for receiving lip portion 38 of catch member 30 of bolt 16.

Figure 4:
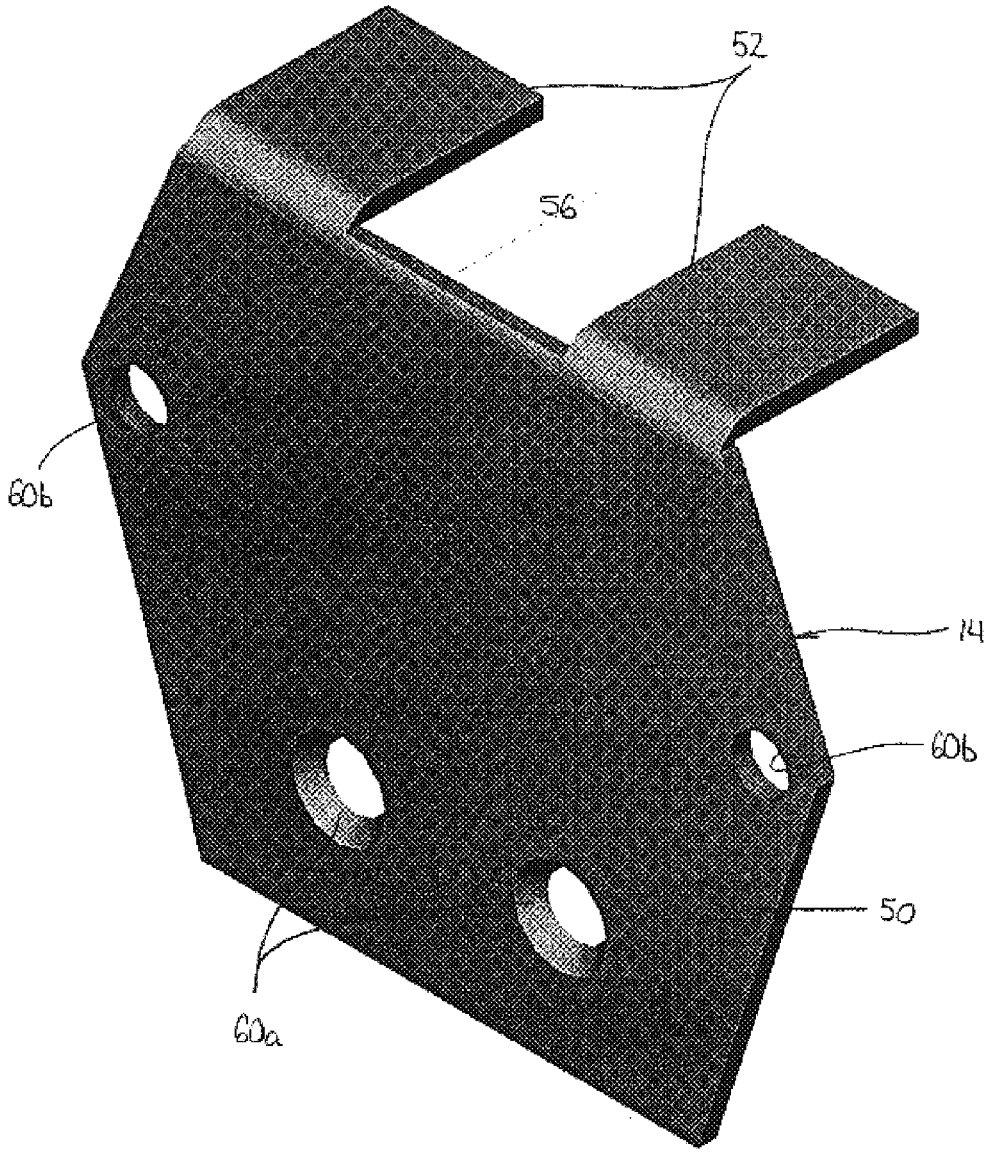
FIG. 4 is a perspective view of the mounting plate of the tamper resistant lock assembly shown in FIG. 1.

Referring to FIGS. 1 and 4, mounting plate 14 includes a plate portion 50 and a pair of perpendicular spaced arms 52. Arms 52 define a slot 56 dimensioned to slidably receive bolt 16. Plate portion 50 includes a series of throughbores 60*a* and 60*b*. Throughbores 60*a* are positioned to receive bolts (not shown) for securing mounting plate 14 to lock housing 12. Alternately, other known engagement structure may be provided to secure the mounting plate to the lock housing. Throughbores 60*b* are positioned to facilitate mounting of lock assembly 10 to a support structure.

Referring again to FIG. 1, bolt 16 is slidably positioned within base portion 19 of lock housing 12. A biasing member (not shown) is supported within base portion 19 to urge bolt 16 to a retracted or locking position, i.e., to a position in which catch member 30 is pulled towards lock housing 12 in the direction indicated by arrow "A". The biasing member 19 may include one or more springs in tension positioned between the end of bolt 16 opposite catch member 30 and an inner wall of base portion 19 of lock housing 12. Alternately, other biasing members and arrangements are envisioned. Bolt 16 is movable to an extended or release position by inserting a key into key slot 24 and rotating the key in a known manner.

In use, when strike 18 is secured to a stationary member, e.g., a door jam, and housing 12 is mounted to a movable member, e.g., a door, and the door is closed, lip portion 38 of catch member 30 of bolt 16 engages lip portion 48 of engagement portion 42. Each lip portion 38 and 48 includes a curved or angled portion 38*a* and 48*a* (FIG. 1), respectively. When the door is closed, angled portions 38*a* and 48*a* contact each other and bolt 16 is cammed to the release position against the force of the biasing member. When the door is closed sufficiently to advance lip portion 38 past lip portion 48, lip portion 38 moves to a position within recess 41 of engagement portion 42 of strike 18 such that strike 18 and bolt 16 are in interlocking engagement. As discussed above, bolt 16 can be moved to the release position, i.e., an extended position in which catch member 30 is spaced from housing 12 a distance sufficient to remove lip portion 38 from recess 41, to facilitate opening of the door. By providing an interlocking bolt and strike assembly wherein the bolt moves towards the lock housing to engage the strike, any attempt to pry the door open will only move the strike and the bolt into tighter engagement.

It will be understood that various modifications may be made to the embodiments disclosed herein. For example, the lip portions on the strike and the bolt need not be continuous lengths of material but rather may include only projections or tabs. Moreover, lock assembly 10 may be constructed from a plurality of different materials including metals and plastics. Therefore, the above description should not be construed as limiting, but merely as exemplifications of preferred embodiments. Those skilled in the art will envision other modifications within the scope and spirit of the claims appended hereto.

What is claimed is:

1. A tamper-resistant lock assembly comprising:

a lock housing;

a core having a longitudinal core axis, and including a key slot supported by the lock housing; and a bolt slidably positioned within the lock housing and having a catch member extending from the lock housing, the bolt defining a longitudinal bolt axis which extends through the catch member and the lock housing, such that the longitudinal bolt axis is perpendicular to the longitudinal core axis, the catch member being substantially C-shaped and including a first sidewall, a first transverse extension and a first lip portion, the first lip portion having an axis that is substantially parallel to the axis of the first sidewall to define a first recess between the first sidewall and the first lip portion, the bolt being movable in response to rotation of the core in a direction away from the lock housing along the longitudinal bolt axis from a locked position to a release position.

2. A tamper-resistant lock assembly according to claim 1, further including a mounting plate fastened to the lock housing, the mounting plate being adapted to be secured to a movable member.

3. A tamper resistant lock assembly according to claim 1, further including a strike member including an engagement portion configured to interlock with the catch member of the bolt.

4. A tamper resistant lock assembly according to claim 3, wherein the engagement portion has a substantially C-shape and includes a second sidewall, a second transverse extension, and a second lip portion which define a second recess, the second recess being configured to receive the first lip portion.

5. A tamper resistant lock assembly according to claim 1, further including a biasing member positioned within the lock housing to urge the bolt to the locked position.

6. A tamper resistant lock assembly according to claim 1, wherein a portion of the catch member between the first lip portion and the first transverse extension includes a curved outer surface.

7. A tamper resistant lock assembly according to claim 3, wherein the engagement portion includes a curved outer surface at the junction between the second transverse extension and the second lip portion.

8. A tamper resistant lock assembly according to claim 3, wherein the strike member is adapted to be mounted on a support structure.

9. A tamper resistant lock assembly according to claim 3, wherein the lock housing is adapted to be secured to a door and the strike member is adapted to be secured to a door jam.

10. A tamper resistant lock assembly comprising:

a lock housing including a core having a longitudinal core axis;

a bolt slidably positioned within the lock housing and having a catch member positioned externally of the lock housing, the bolt defining a longitudinal bolt axis and being linearly movable along the longitudinal bolt axis to move the catch member in a direction away from the lock housing from a locked position to a release position, the longitudinal bolt axis extending though the lock housing and the catch member, such that the longitudinal bolt axis is perpendicular to the longitudinal core axis.

11. A tamper resistant lock assembly according to claim 10, wherein the catch member is substantially C-shaped and defines a recess dimensioned to receive a portion of a strike member.

12. A tamper resistant lock assembly according to claim 11, wherein the catch member includes a sidewall, a transverse extension and a lip portion which together define the substantially C-shape.

13. A tamper resistant lock assembly according to claim 12, wherein the lock housing supports a lock core, the lock core including a key slot for receiving a key.

14. A tamper resistant lock assembly according to claim 13, wherein a portion of the catch member adjoining the lip portion and the transverse extension includes a curved outer surface.

15. A tamper resistant lock assembly according to claim 10, further including a biasing member positioned within the lock housing adjacent the bolt to urge the bolt in a direction to move the catch member towards the lock housing.

16. A tamper resistant lock assembly according to claim 10, further including a strike member including an engagement portion configured to interlock with the catch member of the bolt.

17. A tamper resistant lock assembly according to claim 16, wherein the catch member includes a sidewall, a transverse extension and a lip portion which together define the substantially C-shape.

18. A tamper resistant lock assembly according to claim 16, wherein the engagement portion has a substantially C-shape and includes a second sidewall, a second transverse extension, and a second lip portion which define a second recess, the second recess being configured to receive the first lip portion.

19. A tamper resistant lock assembly according to claim 18, wherein the engagement portion includes a curved outer surface at the junction between the second transverse extension and the second lip portion.

* * * * *